US007399366B1

(12) United States Patent
Wegner et al.

(10) Patent No.: US 7,399,366 B1
(45) Date of Patent: Jul. 15, 2008

(54) PRODUCT AND PROCESSES FOR PREVENTING THE OCCURRENCE OF RUST STAINS RESULTING FROM IRRIGATION SYSTEMS USING WATER CONTAINING IRON IONS AND FOR CLEANING OFF RUST STAINS RESULTING FROM USING SAID IRRIGATION SYSTEMS

(76) Inventors: Paul Wegner, 1340 Eaton Ave., San Carlos, CA (US) 94070; Frank J. Benasutti, 17294 Bermuda Village Dr., Boca Raton, FL (US) 33487

( * ) Notice: Subject to any disclaimer, the term of this patent is extended or adjusted under 35 U.S.C. 154(b) by 0 days.

(21) Appl. No.: 11/799,541

(22) Filed: May 1, 2007

(51) Int. Cl.
*B08B 3/04* (2006.01)

(52) U.S. Cl. ..... 134/26; 134/2; 134/10; 134/27; 134/29; 134/36; 134/42; 210/696; 422/14; 252/175; 47/1.5; 47/48.5; 47/1.01 R

(58) Field of Classification Search ..... 134/2, 134/10, 26, 27, 29, 36, 42; 210/696; 252/175; 47/1.5, 48.5, 1.01 R; 422/14
See application file for complete search history.

(56) References Cited

U.S. PATENT DOCUMENTS

| | | | | | |
|---|---|---|---|---|---|
| 1,988,823 | A * | 1/1935 | Winning et al. | ..... | 510/258 |
| 2,101,197 | A * | 12/1937 | Rice | ..... | 210/662 |
| 2,360,509 | A | 10/1944 | Morgan et al. | | |
| 2,585,616 | A | 2/1952 | Barnes | | |
| 2,694,657 | A | 11/1954 | Brundin | | |
| 3,804,757 | A * | 4/1974 | Ruschenburg | ..... | 210/750 |
| 4,578,243 | A | 3/1986 | Quinlan | | |
| 4,828,743 | A | 5/1989 | Rahfield et al. | | |
| 5,685,993 | A * | 11/1997 | Liu | ..... | 210/695 |
| 5,700,377 | A * | 12/1997 | Cox | ..... | 210/724 |
| 6,361,613 | B2 | 3/2002 | Lee | | |
| 6,524,397 | B2 | 2/2003 | Sakurai et al. | | |
| 6,528,468 | B2 | 3/2003 | Matsukawa et al. | | |
| 2004/0082489 | A1 * | 4/2004 | Gernon et al. | ..... | 510/175 |
| 2007/0023359 | A1 * | 2/2007 | Grott | ..... | 210/670 |

* cited by examiner

*Primary Examiner*—Sharidan Carrillo
(74) *Attorney, Agent, or Firm*—Frank J. Benasutti

(57) ABSTRACT

Several products and processes for preventing the occurrence of rust stains resulting from irrigation systems using water having iron ions, such as well water, and for cleaning off rust stains resulting from the use of said irrigation systems are disclosed. In one embodiment, ammonium sulfate is mixed with well water and then this mixture is mixed with incoming well water being sprayed on the surfaces. In another embodiment, ammonium bisulfate is used for the removal of rust stains. Then ammonium sulfate is mixed with the incoming well water being sprayed in the next cycle, to prevent rust formation.

2 Claims, No Drawings

PRODUCT AND PROCESSES FOR PREVENTING THE OCCURRENCE OF RUST STAINS RESULTING FROM IRRIGATION SYSTEMS USING WATER CONTAINING IRON IONS AND FOR CLEANING OFF RUST STAINS RESULTING FROM USING SAID IRRIGATION SYSTEMS

BACKGROUND OF THE INVENTION

1. Technical Field

This invention relates to treating clean surfaces with well water containing an agent to inhibit the formation of rust and to cleaning off rust stains from surfaces that have been treated with water containing iron ions, such as the porous surfaces of plants and concrete which have been sprayed with water drawn from a well.

2. Description of the Prior Art

In the prior art it was known to clean off rust stains from the porous surfaces of plants and concrete that have been treated with water containing iron ions, such as surfaces which have been sprayed with water drawn from a well. The most common cleaners contain oxalic acid. This acid containing product is applied after the spraying has ceased. Once applied, this acid had to be treated with water the remove it; after it had cleaned off the rust.

Rust inhibitors containing other substances were then mixed with the incoming well water being sprayed in the next cycle, to prevent further rust formulation.

We have found that current products are not effective over the long run in preventing rust stain reoccurrence.

SUMMARY OF INVENTION

Our invention comprises several products and processes for preventing the occurrence of rust stains resulting from well water irrigation systems and for cleaning off rust stains resulting from well water irrigation systems.

In one embodiment, we mix ammonium sulfate with well water to form a solution. Then we mix this resulting solution with incoming well water and then treat the surfaces with this mixture of well water to prevent rust formation.

In another embodiment, we mix ammonium bisulfate with water and treat surfaces containing rust stains with this dilute ammonium bisulfate for removal of rust stains. Then we mix ammonium sulfate with the incoming well water being sprayed in the next cycle, to prevent rust formation.

DESCRIPTION OF THE PREFERRED EMBODIMENTS

In the preferred embodiment, mix ammonium sulfate with well water to form a solution. Then add this resulting solution to the well water being sprayed out in an irrigation system to prevent rust formation on the porous surfaces of plants and concrete being sprayed. This solution can be prepared using one teaspoon of ammonium sulfate to one gallon of water.

Note that if the water is neutral and has low dissolved solids in it, it would take very little ammonium sulfate to make the water slightly acidic and prevent rust formation.

In another embodiment, mix ammonium bisulfate with water to form a dilute solution. Then treat surfaces containing rust stains with this dilute solution of ammonium bisulfate for removal of rust stains. Then mix a solution of ammonium sulfate with the incoming well water being sprayed in the next cycle (as described above in connection with the preferred embodiment), on the surfaces that had been treated and thus prevent rust formation.

One method of making ammonium bisulfate is to mix 1.5 gal of battery acid (H2SO4) with 7.5 pounds of ammonium sulfate. The resulting solution can then be diluted with an equal amount of water.

This may then be diluted by half again with water.

Apply this resulting solution to stained areas to remove the rust stains.

In alternate embodiments, this solution may be further diluted with water and then applied to stained areas until the diluted solution is no longer effective in removing rust stains. By this trial and error method, the most cost effective rust removal solution may be determined.

Once the rust has been removed, and before the surfaces are dry, treat the surfaces again with an ammonium sulfate solution (as described above in connection with the preferred embodiment) prevent rust formation.

One way to effect this second treatment is to add this second solution to the last ten percent of the initial spraying cycle in an irrigation system spraying well water. This may be accomplished by providing a duplicate parallel timer controlled well pump activation system; set to recycle the irrigation at ten percent of the times used in the irrigation cycle. This duplicate system should include a container for the solution to be added and a means of withdrawing the solution and introducing it into well water being sprayed.

Testing in the actual environment should be done to show the frequency of application needed to prevent rust re-occurrence.

The invention claimed is:

1. A method of preventing the formation of rust stains on porous surfaces, which stains could result from well water being sprayed on the porous surfaces by an irrigation system, said method comprising:

treating the well water coming into the irrigation system with a mixture consisting of ammonium sulfate and water; and spraying said mixture on said porous surfaces to prevent the formation of said rust stains on said porous surfaces.

2. A method of treating porous surfaces containing rust stains to remove the rust stains and prevent the formation of rust stains thereafter, said method comprising in sequence:

treating the rust stains with a solution of ammonium bisulfate and water for removal of said rust stains from said porous surfaces, said rust stains resulting from well water being sprayed on the porous surfaces by a first irrigation cycle;

mixing a solution of ammonium sulfate with incoming well water from an irrigation system; and spraying said mixed solution onto said porous surfaces in a second irrigation cycle to prevent rust formation on said porous surfaces.

* * * * *